US007824224B2

(12) United States Patent
Su et al.

(10) Patent No.: US 7,824,224 B2
(45) Date of Patent: Nov. 2, 2010

(54) PRINTED BOARD CONNECTOR

(75) Inventors: Hou-An Su, Keelung (TW); Xiaofeng Duan, Xishui County (CN)

(73) Assignee: Nextronics Engineering Corp., Taipei County (TW)

( * ) Notice: Subject to any disclaimer, the term of this patent is extended or adjusted under 35 U.S.C. 154(b) by 0 days.

(21) Appl. No.: 12/544,059

(22) Filed: Aug. 19, 2009

(65) Prior Publication Data

US 2010/0136839 A1 Jun. 3, 2010

(30) Foreign Application Priority Data

Nov. 28, 2008 (TW) ..... 97221431 U

(51) Int. Cl.
*H01R 24/00* (2006.01)

(52) U.S. Cl. ..... 439/629; 439/637; 439/607.05

(58) Field of Classification Search ..... 439/629, 439/637, 636, 607.05, 607.06, 607.07, 607.08
See application file for complete search history.

(56) References Cited

U.S. PATENT DOCUMENTS 5,716,237 A * 2/1998 Conorich et al. ..... 439/660
6,439,928 B1 * 8/2002 Akama et al. ..... 439/607.09
6,464,537 B1 * 10/2002 Letourneau et al. .... 439/607.14
7,229,319 B2 * 6/2007 Dahms et al. ..... 439/607.06
7,275,966 B2 * 10/2007 Poh et al. ..... 439/636
7,410,392 B2 * 8/2008 Szczesny et al. ..... 439/607.05
7,604,510 B2 * 10/2009 Akama et al. ..... 439/637
7,682,192 B2 * 3/2010 Sawdy et al. ..... 439/607.05
2007/0141913 A1 * 6/2007 Szczesny ..... 439/637

* cited by examiner

*Primary Examiner*—Hae Moon Hyeon
(74) *Attorney, Agent, or Firm*—Muncy, Geissler, Olds & Lowe, PLLC

(57) ABSTRACT

The present invention provides a printed board connector reinforced with a circuit board, and the printed board connector includes an insulating casing, a plurality of signal modules, and a plurality of metal shielding elements. The insulating casing includes a rib. The rib extends a plurality of insulating shielding walls downwardly and the signal modules are received between the insulating shielding walls and are tightly mounted in the rib. The metal shielding elements are received between the insulating shielding walls and are tightly mounted in the rib and the signal modules. When a user presses the printed circuit connector to connect with a circuit board, the rib guides and positions the signal modules and the metal shielding elements, moreover, the rib enhances the strength of the assembling with the circuit board.

17 Claims, 8 Drawing Sheets

PRINTED BOARD CONNECTOR

BACKGROUND OF THE INVENTION

1. Field of the Invention The present invention relates to a connector, especially for a printed board connector reinforced with a circuit board.

2. Description of Related Art

U.S. Pat. No. 7,229,319 provides a printed board connector which is often be used in industry, the printed board connector disclosed in U.S. Pat. No. 7,229,319 includes an insulating casing, a plurality of signal modules, and a plurality of metal shielding devices, the signal modules and the metal shielding devices are received inside the insulating casing, wherein each signal module includes a plastic housing and a pair of signal terminals penetrating the plastic housing, two ends of each signal terminal stretch out of a top side and a bottom side of the insulating casing, each metal shielding device clips with the insulating casing and is positioned between two of the signal modules, and two of the signal terminals respectively are separated by each metal shielding device.

When a user presses the printed board connector to connect with a circuit board, the circuit board provides a reacting force to the signal modules and metal shielding devices at the same time. The reacting force often moves the signal modules and metal shielding devices into the insulating casing and has the effect that the signal terminals and the metal shielding devices cannot be pressed onto a correct position of a surface of the circuit board. Thus, it is not convenient for any user to use the printed board connector disclosed in U.S. Pat. No. 7,229,319.

Hence, the inventors of the present invention believe that the shortcomings described above can be improved and finally suggest the present invention which is of a reasonable design and is an effective improvement based on deep research and thought.

SUMMARY OF THE INVENTION

It is an object of the present invention to provide a printed board connector that reinforces the assembly of the printed board connector with the circuit board.

To achieve the above object, the present invention provides a printed board connector reinforced with a circuit board, and the printed board connector includes an insulating casing, a plurality of signal modules, and a plurality of metal shielding elements. The insulating casing includes a first inner wall and a second inner wall which is opposite to the first inner wall, two ends of a rib are connected to the first inner wall and the second inner wall respectively, and a first receiving space and a second receiving space are formed in the insulating casing and are separated by the rib. A plurality of insulating shielding walls extend from the rib toward the second receiving space, and the signal modules are received between the insulating shielding walls and are tightly mounted in the rib. The metal shielding elements are received between the insulating shielding walls and are tightly mounted in the rib and the signal modules.

When a user presses the printed circuit connector to connect with a circuit board, the rib, which is inside the insulating casing, guides and positions the signal modules and the metal shielding elements. Moreover, the rib enhances the strength of the assembly of the printed board connector with the circuit board.

DETAILED DESCRIPTION OF THE PREFERRED EMBODIMENTS

Figure 1:
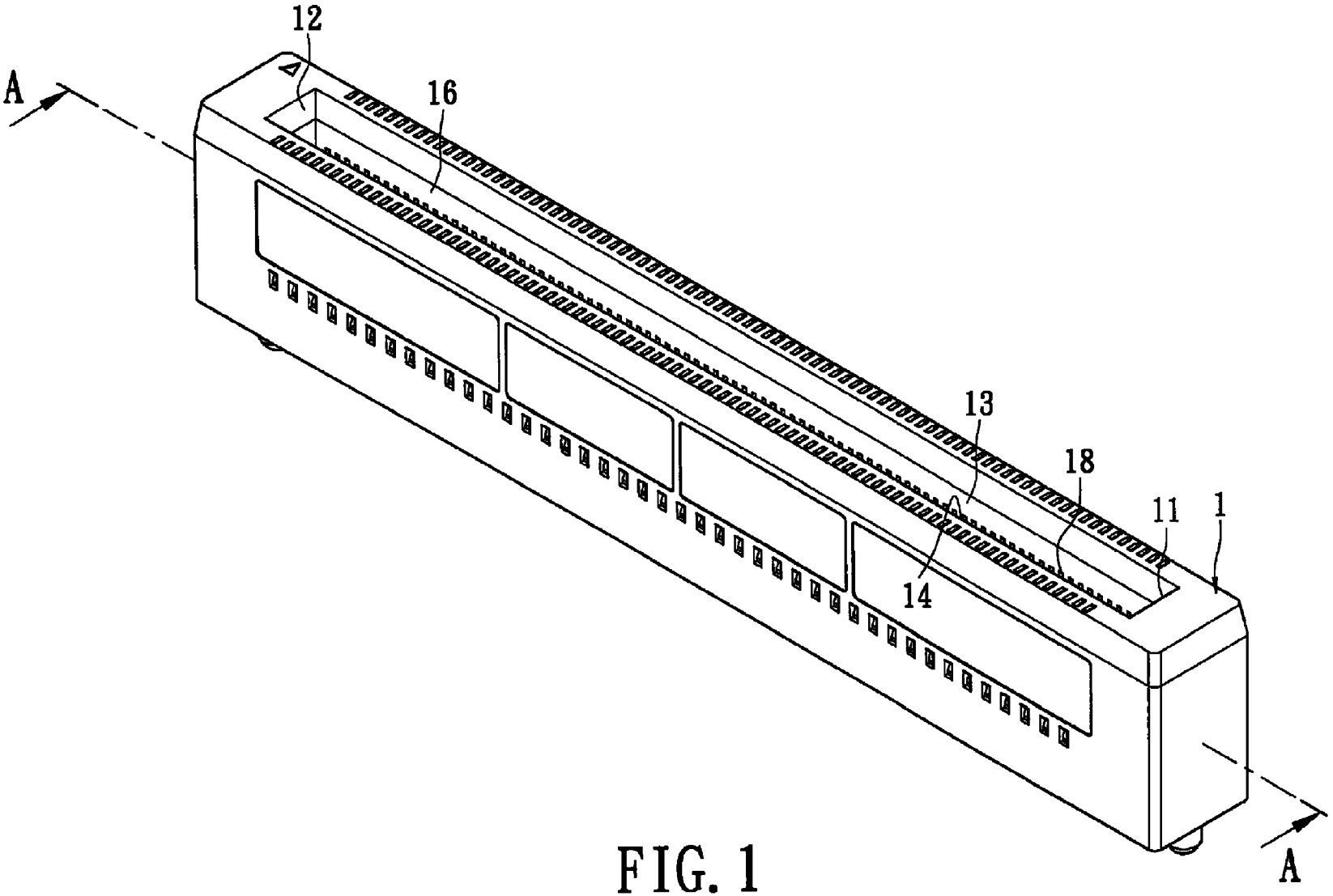
FIG. 1 is a perspective view of the present invention.
Figure 2:
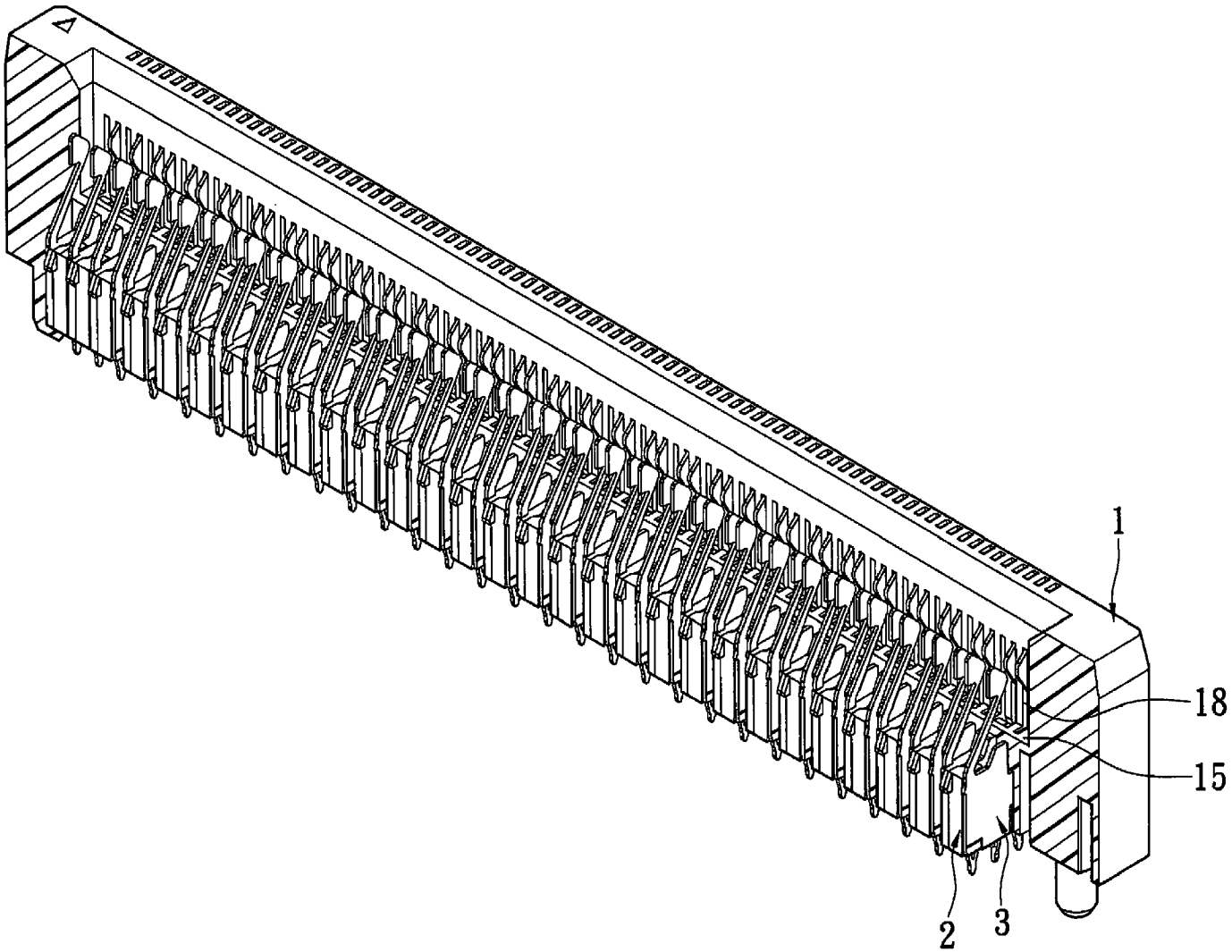
FIG. 2 is a cross-sectional view of the present invention.
Figure 3:
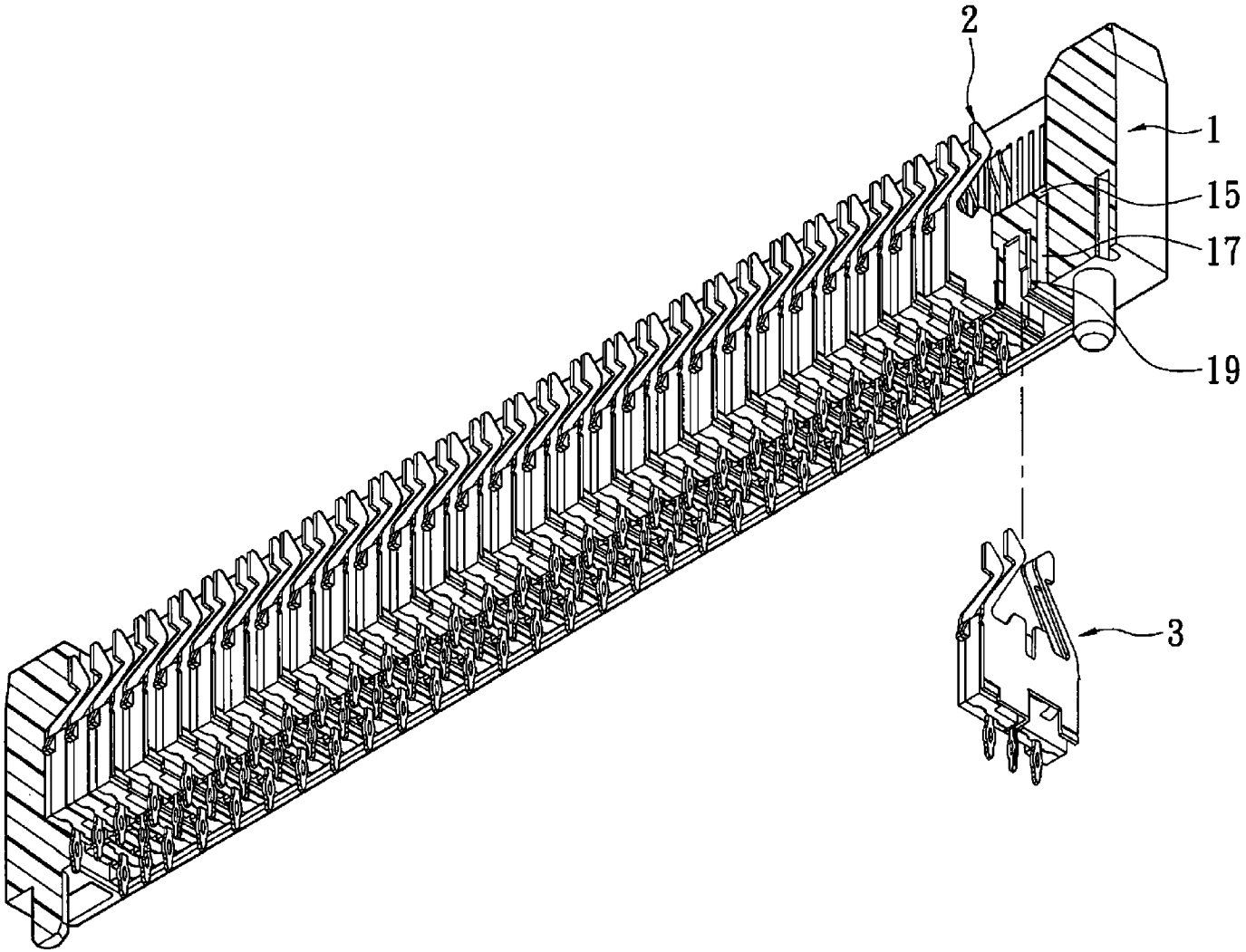
FIG. 3 is another cross-sectional view of the present invention at different viewpoint.

As shown in FIG. 1 to FIG. 3, the present invention discloses a printed board connector reinforced with a circuit board, and the printed board connector includes an insulating casing 1, a plurality of signal modules 2, and a plurality of metal shielding elements 3.

The insulating casing 1 has a first inner wall 11, a second inner wall 12 which is opposite to the first inner wall 11, a third inner wall 13, and a forth inner wall 14 which is opposite to the third inner wall 13. The first inner wall 11, the second inner wall 12, the third inner wall 13, and the forth inner wall 14 form an enclosure wall, and two ends of a rib 15 are connected with the first inner wall 11 and second inner wall 12 respectively.

A first receiving space 16 and a second receiving space 17 are formed in the insulating casing 1 and are separated by the rib 15. The first receiving space 16 is a long and narrow groove and a plurality of terminal grooves 18 are mounted on the two side walls of the receiving space 16, and the positions of the terminal grooves 18 which are on the opposite sides are corresponding. A plurality insulating shielding walls 19 extend from the rib 15 toward the second receiving space 17, the rib 15 and the insulating shielding walls 19 are one piece, and the insulating shielding walls 19 are used to avoid signal disturbances.

Figure 4:
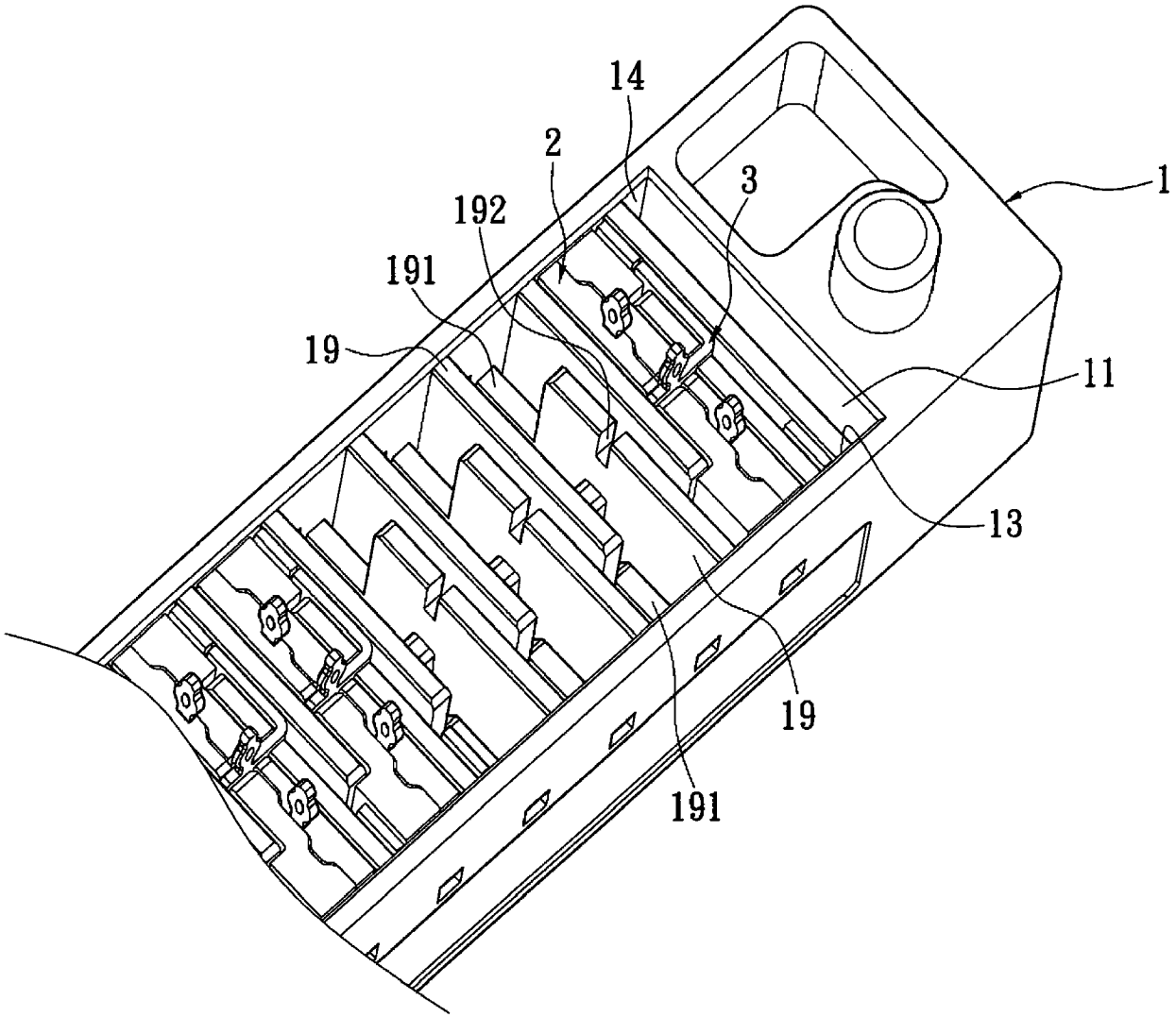
FIG. 4 is a bottom view of the present invention.

As shown in FIG. 2 to FIG. 4, the insulating shielding walls 19 are connected between the third inner wall 13 and the forth inner wall 14, and the insulating shielding walls 19 and the insulating casing 1 are one piece. Each of the insulating shielding walls 19 has a recess 191, and some of the recesses 191 are close to the third inner wall 13 and the other recesses 191 are close to the forth inner wall 14.

Figure 5:
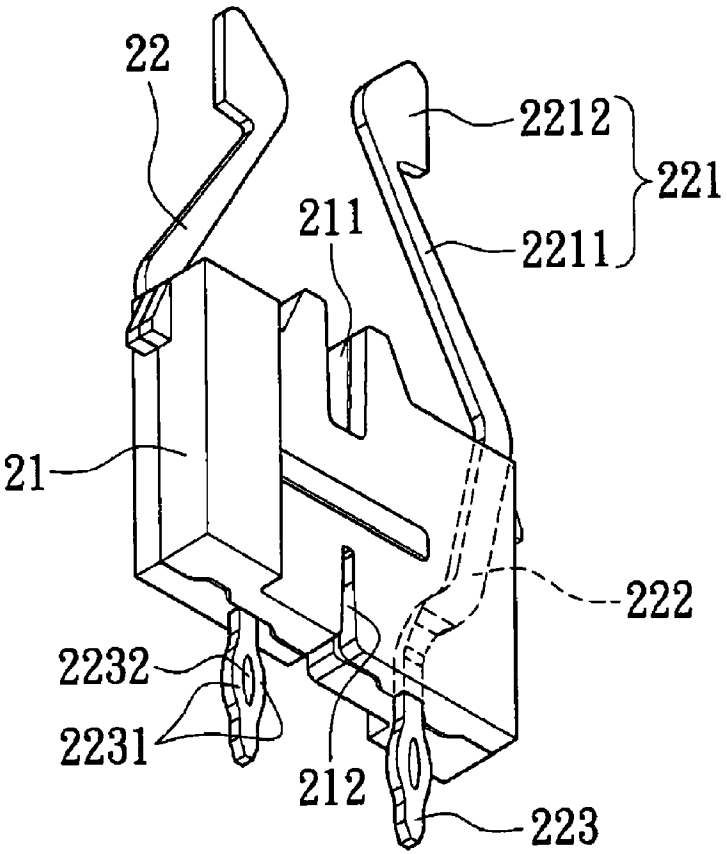
FIG. 5 is a perspective view of the signal module of the present invention.

As shown in FIG. 4 and FIG. 5, one of the signal modules 2 along with one of the metal shielding elements 3 respectively are placed between two of the insulating shielding walls 19, and each of the signal modules 2 includes an insulating housing 21 and a pair of signal terminals 22 which are made of metal and are passed through the insulating housing 21, and two of the signal terminals 22 are responsible for outputting differential signal respectively.

Each of the signal terminals 22 has a first plugging portion 221, a fixing portion 222 and a first connecting portion 223. The fixing portion 222 is extended from the first plugging portion 221 and is bent relative to the first plugging portion 221. The first connecting portion 223 is extended from the fixing portion 222 and is bent relative to the fixing portion 222. The fixing portions 222 are inserted into corresponding insulating housing 21, the first plugging portions 221 and the first connecting portions 223 are stretched out on opposite sides of each of the insulating housings 21, and the first connecting portions 223 are responsible for connecting with a circuit board.

A first groove 211 is positioned at a top surface of each of the insulating housings 21, and a second groove 212 is positioned at a bottom surface of each of the insulating housings 21. The rib 15 is wedged with the first groove 211 (as shown in FIG. 2) and another portion of the insulating housing 21 is wedged with the recesses 191, so as to reinforce the assembly of the printed board connector with the circuit board. Each of the second grooves 212 is mounted between the pair of the first connecting portions 223, so as to shielding off a signal produced by the first connecting portions 223 which are positioned at two sides of the metal shielding element 3.

Each of the first plugging portions 221 includes a first elastic arm 2211 and a first piece 2212, the first piece 2212 is extended from the first elastic arm 2211 and is bent relative to the first elastic arm 2211 with an angle. The first plugging portions 221 pass through terminal grooves 18 respectively (as shown in FIG. 2), wherein the elastic arms 2211 enter into one side of the terminal grooves 18 respectively, the first pieces 2212 are stretched out another sides of the terminal grooves 18 respectively and enter into the first receiving space 16 (as shown in FIG. 1). As for the fixing portion 222 are received in the second receiving space 17 (as shown in FIG. 3), each of the first connecting portions 223 includes a pair of first elastic curved arms 2231 which form a first through hole 2232 between them, the first connecting portions 223 are stretched out the insulating casing 1 and are responsible for connecting with the circuit board.

Figure 6:
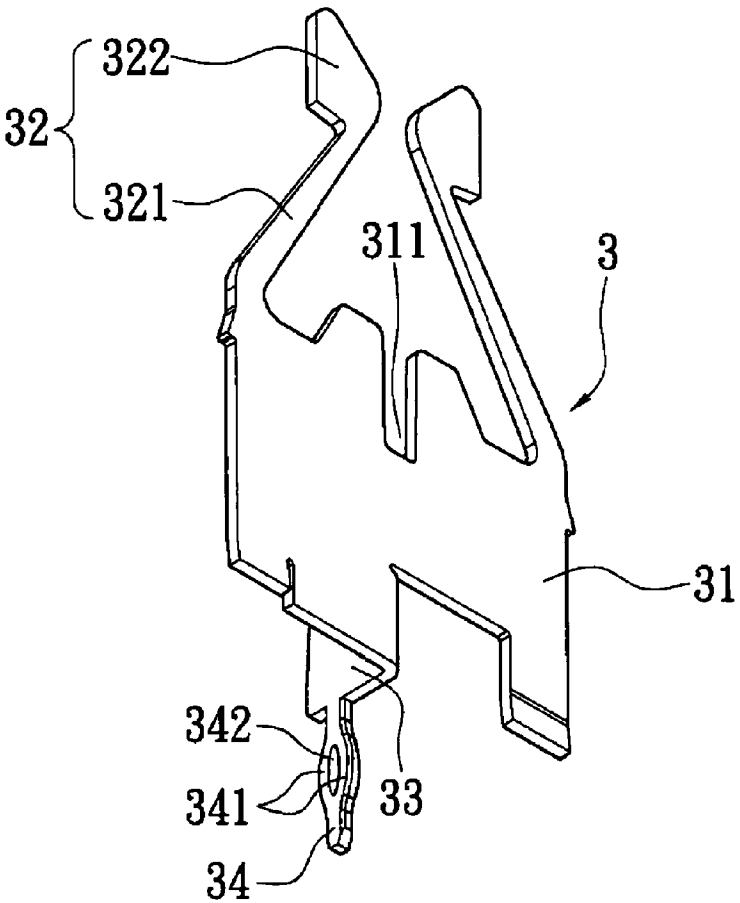
FIG. 6 is a perspective view of the metal shielding element of the present invention.

As shown in FIG. 4 and FIG. 6, the metal shielding element 3 separates signal terminals 22 and prevents signal disturbance caused by adjacent signal terminals 22. Each of the metal shielding elements 3 includes a base portion 31, a pair of second plugging portion 32, a clipping portion 33 and a second connecting portion 34, the second plugging portion 32 and the clipping portion 33 are connected with opposite two sides of the base portion 31, the clipping portion 33 is metal piece and clips with the base 31 vertically, and the second connecting portion 34 is connected one side of the clipping portion 33.

The base portions 31 are received between two of the insulating shielding walls 19 respectively, the second plugging portion 32 is similar to the first plugging portion 221, and the second connecting portion 34 is similar to first connecting portion 223. Each of the second plugging portions 32 has a second elastic arm 321 and a second piece 322, the second piece 322 is extended from the second elastic arm 321 and is bent relative to the second elastic arm 321. The second plugging portions 32 are passed through the terminal grooves 18 respectively 9 (as shown in FIG. 2), wherein the second elastic arms 321 enter in one side of the terminal grooves 18 respectively, as for the second pieces 322 are stretched out another sides of the terminal grooves 18 respectively and enter in the first receiving space 16 (as shown in FIG. 1).

AS for each of the second connecting portions 34 includes a pair of second elastic curved arms 341, which form a second through hole 342 between them, the second connecting portions 34 stretch out of the insulating casing 1 and are responsible for connecting with the circuit board.

A side of each of the base portion 31 has a clipping groove 311, the rib 15 is wedged with the clipping grooves 311 of the metal shielding elements 3, and wherein some of the insulating shielding wall 19 further has a notch 192. The thickness of the notch 192 is corresponding to the thickness of the clipping portion 33. The clipping portions 33 of the metal shielding elements 3 are wedged with the second grooves 212 of the insulating housing 21 respectively, and so as to shielding off signals outputted by first connecting portions 22 which are close to two opposite sides of the clipping portions 33 and preventing signal disturbances. The clipping portions 33 of the metal shielding elements 3 are wedged with the notches 192 of insulating shielding walls 19, and are responsible for increasing the strength of the assembly of the printed board connector with the circuit board.

Figure 7:
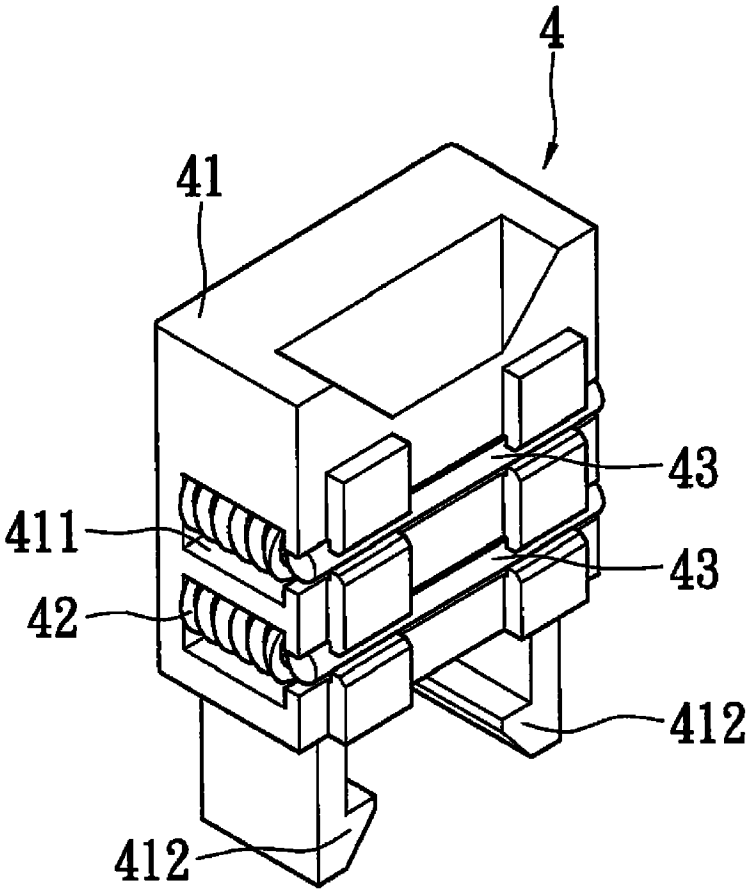
FIG. 7 is a perspective view of a buffer of the present invention.
Figure 8:
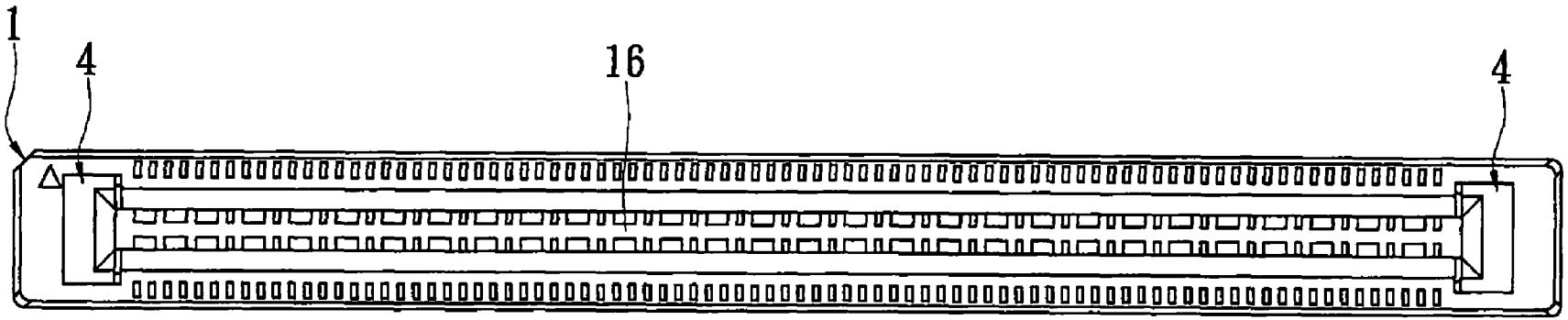
FIG. 8 is a top view of which the buffer is assembled with the insulating casing of the present invention.
Figure 9:
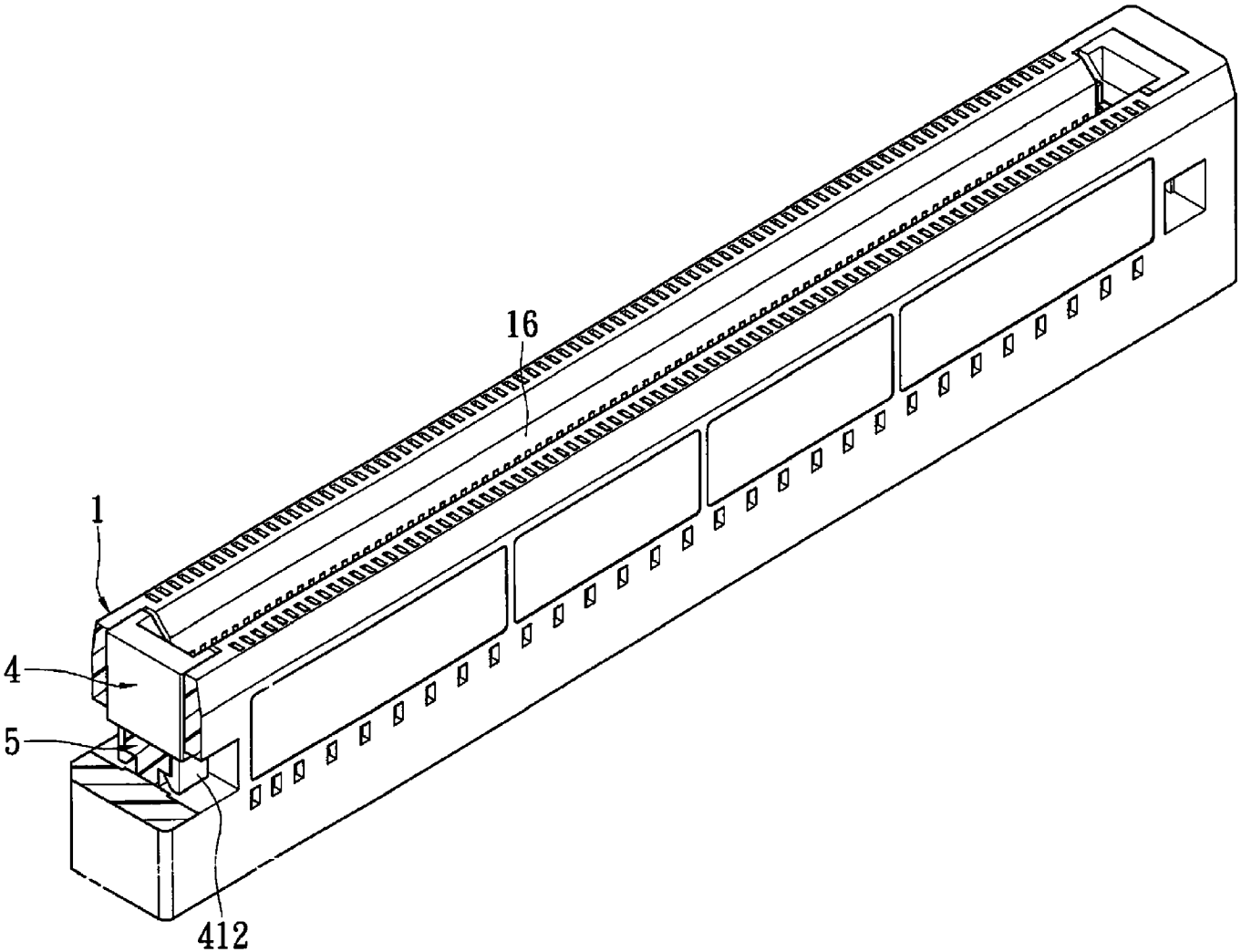
FIG. 9 is a perspective view of which the buffer hooks a protruding block of the insulating casing of the present invention.

As shown in FIG. 7 to FIG. 9, the printed board connector reinforced with a circuit board of the present invention further comprises a pair of buffers 4, the pair of buffers 4 is assembled at two ends of the first receiving space 16, and two T-shaped protruding blocks 5 are formed at the two ends of the first receiving space 16. Each buffer 4 has a main body 41, four springs 42 and two rollers 43, a plurality of spring receiving grooves 411 are concavely formed in the main body 41 and each spring receiving groove 411 are mounted across two neighbor surfaces of the main body 41. The spring receiving grooves 411 are used for receiving the springs 42, wherein the lengths of the springs 42 are longer than the depths of the spring receiving grooves 411 so that the springs 42 are prepressed. The main boy 41 downwardly extends to form two inverse hooks 412, and the inverse hooks 412 hook the protruding blocks 5, the two ends of each rollers 43 presses on one surface of the main body 41 and the springs 42.

The present invention has the following characteristics.

1. When the printed board connector is pressed on the circuit board and is electrically connected with a circuit board, the rib 15 of the insulating casing 1 guides and positions the signal module 2 and the metal shielding element 3, so as to increase the strength of the assembly of the printed board connector with the circuit board.

2. The insulating shielding wall 19 shield off signals outputted from neighbor signal terminals 22 and prevent signal disturbances.

3. The recess 191 of the insulating shielding wall 19 is wedged with signal module 2, the notch 192 of the insulating shielding wall 19 is wedged with metal shielding element 3, and so as to increase the strength of the assembly of the printed board connector with the circuit board.

The above-mentioned descriptions represent merely the preferred embodiment of the present invention, without any intention to limit the scope of the present invention thereto. Various equivalent changes, alternations, or modifications based on the claims of present invention are all consequently viewed as being embraced by the scope of the present invention.

What is claimed is:

1. A printed board connector reinforced with a circuit board, comprising:

an insulating casing, the insulating casing having a first inner wall, a second inner wall which is opposite to the first inner wall, a third inner wall and a forth inner wall which is opposite to the third inner wall, the first inner wall, the second inner wall, and the third inner wall, and along with the forth inner wall an enclosing wall is formed, two ends of a rib connected with the first inner wall and the second inner wall respectively, the rib partitioning the insulating casing and forming a first receiving space and a second receiving space inside the insulating casing, a plurality of insulating shielding walls extending from the rib toward the second receiving space, two ends of each of the insulating shielding walls are connected with the third inner wall and the forth inner wall respectively, each of the insulating shielding walls has a recess;

a plurality of signal modules, the signal modules received between two of the insulating shielding walls respectively and wedged with the ribs, and the signal modules are wedged with the recesses respectively; and a plurality of metal shielding elements, the metal shielding elements received between two of the insulating shielding walls respectively and wedged with the rib and the signal modules.

2. The printed board connector reinforced with a circuit board as claimed in claim 1, wherein some of the recesses are close to the third inner wall and the other recesses are close to the forth inner wall.

3. The printed board connector reinforced with a circuit board as claimed in claim 1, wherein the rib, the insulating shielding walls, and the insulating casing are one piece.

4. The printed board connector reinforced with a circuit board as claimed in claim 1, wherein each of the signal modules includes an insulating housing and a pair of signal terminals made of metal, the signal terminals pass through the insulating housing, two opposite sides of each of the insulating housings have a first groove and a second groove respectively, the rib is wedged with the first groove of each of the insulating housings, the metal shielding element is wedged with the second groove of each of the insulating housings.

5. The printed board connector reinforced with a circuit board as claimed in claim 4, wherein each of the signal terminals has a first plugging portion, a fixing portion, and a first connecting portion, the fixing portion extends from the first plugging portion and is bent relative to the plugging portion at an angle, and the first connecting portion extends from the fixing portion and is bent relative to the fixing portion at another angle, the fixing portion is inserted inside the insulating housing, and the first plugging portion and the first connecting portion are stretching out from two opposite sides of the insulating housing.

6. The printed board connector reinforced with a circuit board as claimed in claim 5, wherein a plurality of terminal grooves are mounted on two opposite side inner walls inside the first receiving space, and the first plugging portions pass through the terminal grooves respectively.

7. The printed board connector reinforced with a circuit board as claimed in claim 5, wherein the fixing portions are received in the second receiving space, and the first connecting portions stretch out of the insulating casing.

8. The printed board connector reinforced with a circuit board as claimed in claim 5, wherein each of the first plugging portions includes a first elastic arm and a first piece, the first piece is extended from the first elastic arm and is bent relative to the first elastic arm.

9. The printed board connector reinforced with a circuit board as claimed in claim 5, wherein each of the first connecting portions includes a pair of first elastic curved arms, which form a first through hole between the pair of first elastic curved arms.

10. The printed board connector reinforced with a circuit board as claimed in claim 5, wherein each of the metal shielding elements includes a base portion, a pair of second plugging portions, a clipping portion, and a second connecting portion, the second plugging portions and the clipping portions are connected with two opposite sides of the base portions, the clipping portions are connected with the base portions vertically, the clipping portions are wedged with the signal modules, and the second connecting portions are connected with one side of the clipping portions.

11. The printed board connector reinforced with a circuit board as claimed in claim 10, wherein one side of each of the base portions has a clipping groove, and the rib is wedged with the clipping grooves.

12. The printed board connector reinforced with a circuit board as claimed in claim 10, wherein some of the insulating shielding walls have notches respectively, and the clipping portions of the metal shielding element are assembled with the notches of the insulating shielding walls.

13. The printed board connector reinforced with a circuit board as claimed in claim 12, wherein the clipping portions are metal pieces.

14. A printed board connector reinforced with a circuit board, comprising:

an insulating casing, the insulating casing having a first inner wall, a second inner wall which is opposite to the first inner wall, two ends of a rib connected with the first inner wall and the second inner wall respectively, the rib partitioning the insulating casing and forming a first receiving space and a second receiving space inside the insulating casing, a plurality of insulating shielding walls extending from the rib toward the second receiving space;

a plurality of signal modules, the signal modules received between two of the insulating shielding walls respectively and wedged with the ribs;

a plurality of metal shielding elements, the metal shielding elements received between two of the insulating shielding walls respectively and wedged with the rib and the signal modules; and a pair of buffers, each buffer has a main body, a plurality of springs, and a plurality of rollers, a plurality of spring receiving grooves are concavely formed in the main body, and each of the spring grooves is mounted across two neighbor surfaces of the main body, the rollers press on one surface of the main body and the springs.

15. The printed board connector as claimed in claim 14, wherein the lengths of the grooves are longer than the depths of the spring receiving grooves.

16. The printed board connector as claimed in claim 14, wherein the main boy downwardly extends to form two inverse hooks, two protruding blocks are formed inner the insulating casing, and the inverse hooks hook the protruding blocks.

17. The printed board connectors as claimed in claim 16, wherein the protruding blocks are T-shaped blocks.

* * * * *